United States Patent [19]

Nonoyama et al.

[11] 4,192,141

[45] Mar. 11, 1980

[54] EXHAUST GAS PURIFYING SYSTEM FOR ENGINES

[75] Inventors: Takao Nonoyama, Toyota; Takeru Yasuda, Nagoya, both of Japan

[73] Assignee: Toyota Jidosha Kegko Kabushiki Kaisha, Toyota, Japan

[21] Appl. No.: 819,158

[22] Filed: Jul. 26, 1977

[30] Foreign Application Priority Data

May 2, 1977 [JP] Japan ..... 52-50941
May 2, 1977 [JP] Japan ..... 52-50943

[51] Int. Cl.[2] ..... F01N 3/15

[52] U.S. Cl. ..... 60/290; 60/301; 60/306

[58] Field of Search ..... 60/274, 289, 290, 306, 60/301

[56] References Cited

U.S. PATENT DOCUMENTS

| | | | |
|---|---|---|---|
| 3,812,673 | 5/1974 | Muroki | 60/290 |
| 3,826,089 | 7/1974 | Nakajima | 60/290 |
| 3,869,858 | 3/1975 | Goto | 60/290 |
| 3,886,260 | 5/1975 | Unland | 60/301 |
| 3,906,723 | 9/1975 | Matumoto | 60/290 |
| 3,921,396 | 11/1975 | Nohira | 60/290 |
| 4,125,997 | 11/1978 | Abthoff | 60/306 |
| 4,134,262 | 1/1979 | Sugihara | 60/301 |

*Primary Examiner*—Douglas Hart
*Attorney, Agent, or Firm*—Stevens, Davis, Miller & Mosher

[57] ABSTRACT

A system for purifying exhaust gases of engines by first passing the exhaust gases through a 3-way catalyst in a reducing condition, and secondly through an auxiliary catalyst which accelerates at least the oxidizing reaction in an oxidizing condition, wherein the reducing and oxidizing conditions of the exhaust gases are controlled by a programmed supply of secondary air to the exhaust gases at the upstream sides of the two catalysts, the program for the supply of secondary air being predetermined depending upon operational conditions of the engine, such as the rotational speed and the intake manifold vaccum of the engine.

10 Claims, 4 Drawing Figures

EXHAUST GAS PURIFYING SYSTEM FOR ENGINES

BACKGROUND OF THE INVENTION

The present invention relates to purification of exhaust gases of engines.

It is of course not new, and even is currently practised in some automobiles, to mount catalytic converters containing some oxidizing and/or reducing catalyst in the exhaust system of the engine, for the purpose of purifying the exhaust gases of noxious components such as NOx, HC, and CO so that NOx is reduced to innoxious $N_2$ while HC and CO are oxidized to innoxious $CO_2$ and $H_2O$. As a catalyst used for the purification of exhaust gases, there is known a 3-way catalyst which accomplishes simultaneously both acceleration of the reduction of NOx and acceleration of the oxidization of HC and CO. With regard to the purification of NOx, the 3-way catalyst shows a high NOx purification performance in a reducing gas medium richer than a stoichiometric gas mixture, whereas the NOx purification performance abruptly lowers when exhaust gases are diluted by air beyond the stoichiometric gas mixture and are converted into an oxidizing medium including surplus oxygen. On the other hand, with regard to the performance in purification of HC and CO, the 3-way catalyst obviously shows a high HC and CO purification performance when the exhaust gases constitute an oxidizing gas leaner than the stoichiometric gas mixture, but the HC and CO purification performance abruptly lowers when the exhaust gases constitute a reducing mixture richer than the stoichiometric mixture. Because of this characteristic, in the conventional exhaust gas purification system employing the 3-way catalyst, it has been contemplated to maintain exhaust gases exactly in the stoichiometric condition. Therefore, it has been the general practice to effect a strict air/fuel ratio control for the exhaust gases introduced into the catalytic converter by employing an $O_2$ sensor or the like. In this case, it has been contemplated that the air/fuel ratio equivalent of exhaust gases is to be maintained within a relatively narrow range such as $14.5 \pm 0.2$.

However, it is very difficult and requires expensive control means to maintain exhaust gases within such a narrow range around the stoichiometric condition, because the constitution of exhaust gases of an engine changes greatly in accordance with the operating conditions of the automobile.

In view of the aforementioned problems with the conventional exhaust gas purification system for automobiles employing a 3-way catalyst, in a co-pending U.S. patent application Ser. No. 818,870 filed July 25, 1977, now abandoned and assigned to the same assignee as the present application, we have proposed a novel system for purifying exhaust gases of engines which is simple in structure and inexpensive, and yet accomplishes an improved overall exhaust gas purification performance, characterised by a method of purifying exhaust gases of engines comprising the processes of passing the exhaust gases through a 3-way catalyst in a reducing condition richer than the stoichiometric mixture, thereby purifying the exhaust gases of NOx substantially to the target purification rate while simultaneously purifying them of a part of the HC and CO contained therein, adding air to the exhaust gases to convert them into an oxidising medium leaner than the stoichiometric mixture, and then passing the exhaust gases through a second catalyst which accelerates at least the oxidizing reaction thereby purifying the exhaust gases of the remaining HC and CO therein to the final target purification rate.

As mentioned above, a 3-way catalyst has the general characteristic that NOx purification performance abruptly lowers as exhaust gases shift to an oxidizing condition leaner than the stoichiometric mixture while its HC and CO purification performance abruptly lowers as exhaust gases shift to a reducing condition richer than the stoichiometric mixture. In this case, however, it is noted that the falling off rate of HC and CO purification performance in the reducing mixture condition is relatively moderate when compared with the falling off rate of NOx purification performance in the oxidizing condition. The aforementioned method proposed in the co-pending application for purifying exhaust gases of engines originates from noticing this particular characteristic of a 3-way catalyst and emerges from the conventional art of confining the operational region of a 3-way catalyst within a narrow band of the stoichiometric exhaust gas mixture having an air/fuel ratio equivalent such as 14.5 (stoichiometric)$\pm$0.2, in a manner such that the operational region is positively shifted to a reducing region richer than the stoichiometric mixture, thereby avoiding the critical region where NOx purification performance abruptly lowers, and that a 3-way catalyst is used principally for purifying the exhaust gases from NOx under a relatively inexact control of the exhaust gas condition with an incidental purification from a part of HC and CO. In this case, exhaust gases are processed by the modified application of a 3-way catalyst in a manner such that NOx is removed substantially to the final target purification rate while a part of the HC and CO are incidentally removed, and then the exhaust gases are supplied with a supply of air and are converted into an oxidizing mixture leaner than the stoichiometric mixture, and then the exhaust gases are passed through a second catalyst which accelerates at least the oxidizing reaction wherein the HC and CO remaining in the exhaust gases are further removed to the final target purification rate.

In practicing the aforementioned method of purifying exhaust gases, the air/fuel ratio equivalent of the exhaust gases entering into a 3-way catalyst is controlled in a range of approximately 13.5–14.6 in view of the general purification performance of a 3-way catalyst. The air/fuel ratio equivalent of the exhaust gases entering into the second catalyst should preferably be controlled within a range of approximately 14.5–18.0. With regard to the purification rate of the three components NOx, HC and CO, in view of the general purification caracteristics of a 3-way catalyst, it is desirable that the 3-way catalyst purifies the exhaust gases from NOx up to approximately 80–90% while incidentally purifying them from HC up to approximately 80–90% and from CO up to approximately 50–80%, and that the second catalyst purifies them from HC to the fianl target purification rate such as approximately 90–98% and from CO to the final target purification rate such as approximately 85–98%.

By employing the concept of controlling the air/fuel ratio equivalent of exhaust gases within a relatively wide range such as approximately 13.5–14.6 for operating a 3-way catalyst by contrast to the conventional concept of controlling the air/fuel ratio equivalent of exhaust gases within a very narrow range such as 14.5±0.2, it is contemplated that the air/fuel ratio control for exhaust gases is exempt from the conventional strict feedback control depending upon an $O_2$ sensor for detecting oxygen density in the exhaust gases.

SUMMARY OF THE INVENTION

It is therefore the primary object of the present invention to provide a system for purifying exhaust gases of engines which operates depending upon a novel concept with regard to the control of the air/fuel ratio equivalent of the exhaust gases.

In more detail, the present invention proposes to combine the aforementioned concept of employing a combination of a 3-way catalyst and an auxiliary catalyst which accelerates at least the oxidizing reaction in a particular air/fuel ratio condition with a concept of controlling the air/fuel ratio equivalent of the exhaust gases entering into the 3-way catalyst and the auxiliary catalyst by supplying secondary air to the exhaust gases at the upstream sides of the 3-way catalyst and the auxiliary catalyst at first and second predetermined rates depending upon operational conditions of the engine without employing any feedback control, thereby still accomplishing the desired purification of the exhaust gases in a manner that the 3-way catalyst purifies the exhaust gases of NOx substantially to the target purification rate while it simultaneously purifies them of a part of the HC and CO contained therein and then the auxiliary catalyst purifies the exhaust gases of the remaining HC and CO to the final target purification rate.

In accordance with the present invention, the control system for controlling the air/fuel ratio equivalent of exhaust gases is greatly simplified, whereby the initial cost of the exhaust gas purification system is greatly reduced. Furthermore, by the omission of an $O_2$ sensor, which generally has a delicate structure, is subject to malfunctions, and requires a relatively long time for response, an exhaust gas system immune to vibration and shocks and having a quick responsive, stable, and longstanding performance is made available.

As for the operational conditions of the engine which are depended upon for supplying secondary air to exhaust gases at the upstream sides of the 3-way catalyst and the auxiliary catalyst at first and second predetermined rates, the rotational speed of the engine and manifold vacuum may be employed. In normal internal combustion engines, the air/fuel ratio equivalent of exhaust gases is determined by the rotational speed and intake manifold vacuum of the engine, while the flow rate of exhaust gases is also substantially determined by the rotational speed and intake manifold vacuum of the engine. Consequently, the rate of supplying secondary air to the exhaust gases for controlling the air/fuel ratio equivalent thereof at a certain desired value is unconditionally determined by the rotational speed and intake manifold vacuum of the engine. Depending upon this principle, by supplying secondary air to the exhaust gases in accordance with a predetermined program depending upon the operational conditions of the engine such as the rotational speed and intake manifold vacuum of the engine, the air/fuel ratio equivalent of the exhaust gases is constantly maintained within a certain desired range regardless of the operational conditions of the engine. Since in this case the air/fuel ratio equivalent of exhaust gases is controlled to be in the reducing condition by addition of an amount of secondary air, the initial condition of the exhaust gases exhausted from an exhaust port of the engine must be in a relatively rich reducing condition.

In accordance with an additional feature of the present invention, the secondary air supply system may incorporate an additional control system which temporarily increases the supply of secondary air through the aforementioned first supply system, which supplies secondary air to the exhaust gases at the upstream side of the 3-way catalyst, when the engine is in a cold state. This modification depends upon the fact that when an engine is in a cold state, the level of NOx contained in the exhaust gases is so low that it causes no serious problem, whereas the levels of HC and CO are very high. By incorporating the aforementioned modification into the secondary air supply system, the 3-way catalyst is operated at the maximum efficiency with regard to the purification of HC and CO during a cold-state operation of the engine, thereby accomplishing the required purification rate of the exhaust gases.

In accordance with still another feature of the present invention, the programmed control of the secondary air supply, depending upon operational conditions of the engine, may incorporate an additional control system which supplies substantially the whole amount of secondary air to the entrance portion of the 3-way catalyst when the automobile engine is decelerated. In view of the fact that a source of compressed air for use as the secondary air is judiciously obtained by an air pump driven by the engine, it is noted that the amount of compressed air available for use as secondary air greatly increases relative to the heat discharged by the exhaust gases. On the other hand, when the engine is operated in the engine braking condition during deceleration of the vehicle, the level of NOx is so low that it requires no purification by the 3-way catalyst. In view of these conditions, it is contemplated to supply the whole amount of available secondary air to the exhaust gases at the entrance to the 3-way catalyst, thereby accomplishing the effect that, in spite of a small amount of heat generated by the recombustion of HC and CO due to secondary air, the 3-way catalyst as well as the auxiliary catalyst are effectively cooled down by the flow of a relatively large amount of secondary air so that the durability of the catalyst means is improved.

In accordance with still another feature of the present invention, it is proposed that the programmed supply of secondary air depending upon operational conditions of the engine incorporates a control stage for substantially intercepting the supply of both said first and second secondary airs injected into the exhaust system at the upstream sides of the 3-way catalyst and the auxiliary catalyst when the engine is in the full load condition. Such a control stage with respect to the supply of secondary air is very effective for protecting the catalyst means from being damaged by overheating, because the temperature of the exhaust gases reaches a relatively high level in the full load operation of the engine, and if the exhaust gases are further heated up by recombustion of HC and CO contained therein, there is a danger that the catalyst means could be overheated.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DESCRIPTION OF THE PREFERRED EMBODIMENT

Figure 1:
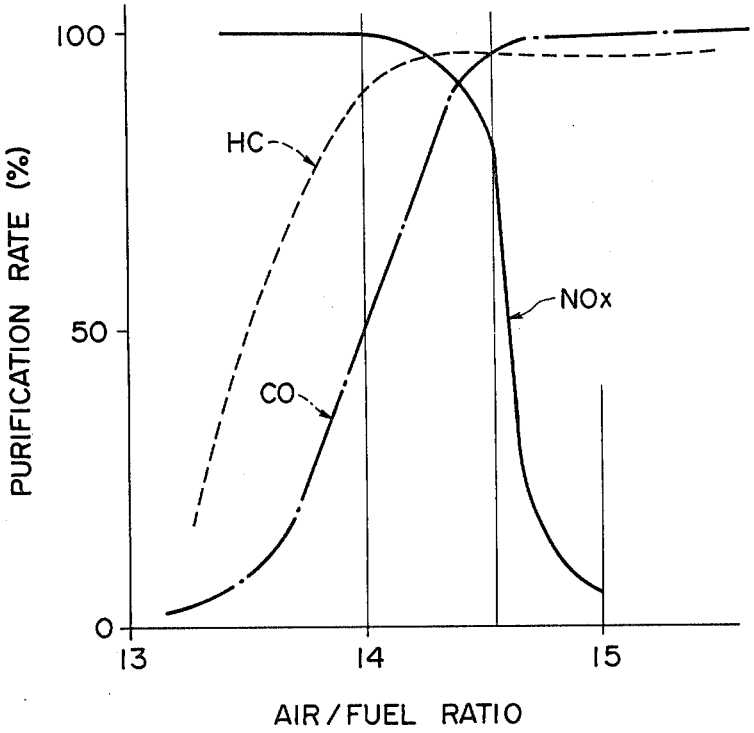
FIG. 1 is a graph showing the general performance of a 3-way catalyst.

Referring to FIG. 1 showing the well-known purification performance relative to air/fuel ratio equivalent of a 3-way catalyst, it is noted that the NOx purification perfromance is sufficiently high for the reducing condition richer than the stoichiometric mixture of an air/fuel ratio equivalent of 14.5 whereas it abruptly lowers in the oxidizing condition having an air/fuel ratio equivalent above the stoichiometric value of 14.5. On the other hand, the HC and CO purification performance is maintained in a satisfactory condition as long as the exhaust gases are in the oxidizing condition, leaner than the stoichiometric mixture, whereas it abruptly lowers when the exhaust gases change to the reducing condition, richer than the stoichiometric mixture. However, as noted in FIG. 1, the falling-off rate of the HC and CO purification performances in the reducing condition is relatively moderate when compared with the falling-off rate of the NOx purification performance in the oxidizing condition. In view of this particular characteristic, the present invention proposes to operate the 3-way catalyst in the reducing gas medium in a region of approximately 13.5–14.6 air/fuel ratio equivalent.

By operating the 3-way catalyst in the aforementioned reducing mixture band, NOx is removed up to a purification rate of approximately 80–90% and incidentally HC and CO are also removed up to purification rates of approximately 80–90% and approximately 50–80% respectively.

Figure 2:
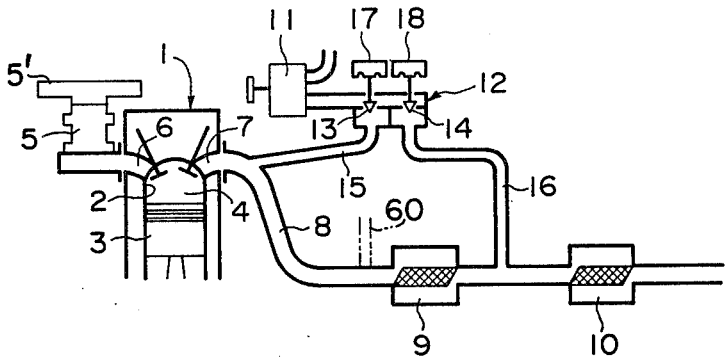
FIG. 2 is a diagrammatical view showing an example of an exhaust system of an engine, in which the system of the present invention for purifying exhaust gases is incorporated.

FIG. 2 is a diagrammatical view showing an exhaust system of an engine in which the system of the present invention is incorporated. In FIG. 2, 1 designates the body of the engine including a cylinder 2, a piston 3 and a combustion chamber 4 defined above the piston. The combustion chamber 4 is supplied with fuel-air mixture generated by a carburetor 5 through an intake port 6. The fuel-air mixture is combusted in the combustion chamber 4 and generates exhaust gases which are exhausted from an exhaust port 7 and through an exhaust system 8 including an exhaust manifold, an exhaust pipe, etc.. The exhaust system further comprises therein a first catalytic converter 9 containing a 3-way catalyst and a second catalytic converter 10 provided at the downstream side of the first catalytic converter and containing a second catalyst which accelerates at least the oxidizing reaction. In the figure, 11 designates an air pump driven by the engine, the air delivered therefrom being supplied to the exhaust system 8 as secondary air under the control of an air control valve 12. In the shown embodiment, the air control valve 12 comprises two control valve elements 13 and 14. The flow of air controlled by the valve element 13 is conducted through a pipe 15 and is introduced into the exhaust system at the exhaust manifold portion thereof, i.e. at the upstream side of the 3-way catalytic converter 9. The flow of air controlled by the valve element 14 is conducted through a pipe 16 and is introduced into the exhaust system at a middle portion located between the 3-way catalytic converter 9 and the second catalytic converter 10. The control valve elements 13 and 14 are operated by diaphragm means 17 and 18, respectively, and are adapted to supply a controlled amount of secondary air to the exhaust system in compliance with variations of the operating condition of the engine in a manner such that the aforementioned conditions of air/fuel ratio equivalent of the invention are constantly maintained. As mentioned above, since the air/fuel ratio equivalent for the 3-way catalyst need not be controlled within a very narrow range such as 14.5 (stoichiometric)$\pm$0.2, but it is sufficient if the ratio equivalent is maintained in a relatively wide range such as approximately 13.5–14.6, the control structure for the valve elements may be of a relatively simple kind. Furthermore, since the control valve element 14 need only supply a sufficient additional amount of air to the exhaust gases discharged from the 3-way catalytic converter 9 to convert them into an oxidizing condition leaner than the stoichiometric mixture, the control for the valve element 14 is not subject to any strict accuracy conditions. Therefore, the control structure for the valve element 14 also may be of a relatively simple and inexpensive kind.

Figure 3:
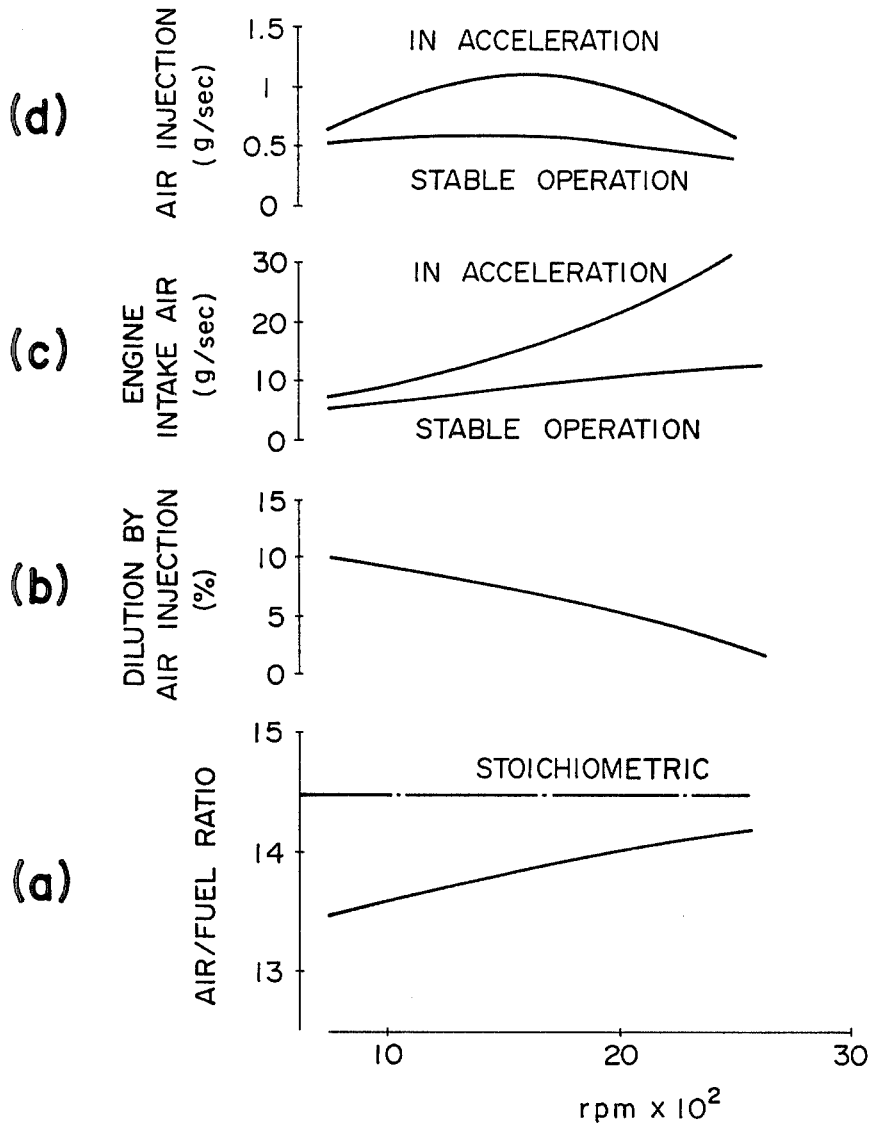
FIG. 3 shows graphs showing various performance characteristics of an engine relative to the rotational speed thereof.

FIG. 3 shows an example of variation of air/fuel ratio (graph a), dilution ratio effected by air injection (graph b), engine intake air flow (graph c), and injection air flow (graph d) in relation to engine rotational speed. As shown by graph a, the air/fuel ratio generally increases when the engine rotational speed increases and, therefore, if the air/fuel ratio equivalent of exhaust gases discharged from the exhaust port is made beforehand a little lower than the stoichiometric value, i.e., a little richer than the stoichiometric mixture, injection of secondary air into the exhaust system in a manner to accomplish a dilution ratio such as shown in graph b can regulate the exhaust gases at the stoichiometric air/fuel ratio equivalent or a particular air/fuel ratio equivalent which is a little smaller (i.e., richer) than the stoichiometric value required for the present invention, throughout the entire rotational speed range of the engine. In this connection, as shown in graph c, intake airflow of the engine in the accelerating condition varies from that in the stable operating condition for the same engine rotational speed. By taking this difference into consideration, the injection air flow in the stable operating condition is to be substantially constant over the entire rotational speed region of the engine, whereas the injection air flow is to show a convex characteristic in the accelerating condition wherein the injection air flow is somewhat increased in a medium speed region as shown in graph d.

Figure 4:
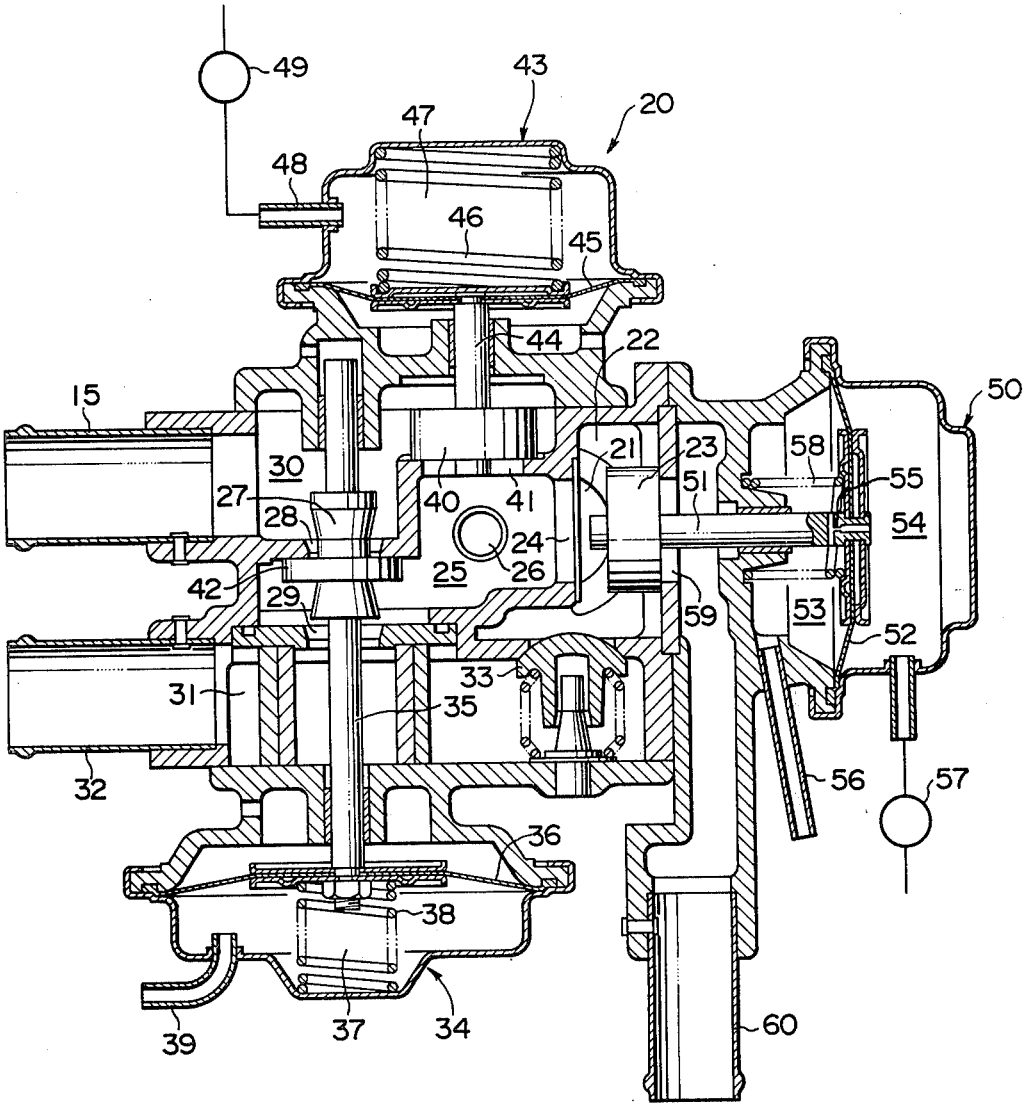
FIG. 4 is a sectional view showing an embodiment of a secondary air control valve to be employed for the system of the present invention.

FIG. 4 shows an embodiment of an air control valve for supplying secondary air to the exhaust system at the upstream sides of the 3-way catalyst and the auxiliary catalyst at first and second predetermined rates depending upon operational conditions of the engine. For the convenience of explanation, let as assume that the air control valve shown in FIG. 4 replaces the air control valve 12 in the system shown in FIG. 2. The air control valve 20 has a composite housing as shown in FIG. 4 which has an air inlet port 21 formed as a part thereof. The air inlet port 21 is supplied with air from a source of compressed air, such as the air pump 11, which is driven by the engine and delivers compressed air at a rate substantially proportional to the rotational speed of the engine. The air supplied to the air inlet port 21 is introduced into a valve chamber 22. When a valve 23, serving as a valve for protecting catalyst from being damaged by burning, is shifted rightward in the Fig., the air introduced into the valve chamber 22 passes through a port 24 and flows into a valve chamber 25. An air outlet port 26 having a constricted orifice means is opened to the valve chamber 25, said port being connected with the pipe 16 so that the air exhausted from the valve chamber 25 through the port 26 is introduced into the exhaust system of the engine at the upstream side of the second catalytic converter 10 containing a second or auxiliary catalyst. From the valve chamber 25 the air flows further through ports 28 and 29 adapted to be controlled by a valve element 27 to enter into valve chambers 30 and 31, respectively. The air which has entered into the valve chamber 30 is conducted through the pipe 15 to be added to the exhaust gases flowing through the exhaust system of the engine at the upstream side of the first catalytic converter 9 containing a 3-way catalyst. On the other hand, the air introduced into the valve chamber 31 is conducted through a pipe 32 to an air cleaner of the air intake system of the engine, like the one designated by 5' in FIG. 2, which serves in this case as a silencer for releasing superfluous air. The valve chamber 22 can also be connected to the valve chamber 31 by way of a relief valve 33 when the air pressure in the valve chamber 32 has increased beyond a predetermined level.

The valve element 27 is operated by a diagram means 34. In more detail, the valve element 27 is connected with a diaphragm 36 of the diaphragm means by way of a rod element 35 whereby the diaphragm element is driven downward in the Fig. when the diaphragm 36 is biased downward in the Fig. against the action of a compression coil spring 38 by a vacuum supplied to a diaphragm chamber 37. The diaphragm chamber 37 is supplied with the intake manifold vacuum of the engine through a pipe 39.

The valve chamber 25 can also be connected to the valve chamber 30 through a port 41 controlled by a valve element 40 which is operated to open the port 41 when the engine is in a cold state as explained hereinafter.

Assuming that the valve elements 23 and 40 are positioned as shown in FIG. 4, the valve element 27 is operated in accordance with operational conditions of the engine in the following manner. When the engine is idling, a relatively large manifold vacuum is supplied to the diaphragm chamber 37, whereby the valve element 27 is shifted to the lowermost position by the diaphragm means 34. In this condition, the port 29 on the relief side is almost fully closed while the port 28 connected with the pipe 15 is also substantially closed, as is obvious from the shape of the valve element 27. Starting from this idling condition, if the throttle valve is gradually opened, thereby increasing the load and rotational speed of the engine, the valve element 27 is gradually shifted upward in the Fig. whereby the port 28 is gradually opened while the port 29 is also gradually opened. In accordance with the relation of the openings of the ports 28 and 29 to the load and rotational speed of the engine as well as in accordance with the relation of the amount of air supplied through the air inlet port 21 to the rotational speed of the engine, the amount of secondary air supplied through the port 28 and the pipe 15 to the upstream side of the main catalyst and the amount of secondary air supplied through the port 26 and the pipe 16 to the upstream side of the auxiliary catalyst are respectively determined. In this case, the amount of secondary air supplied through the port 28 and the pipe 15 is determined in relationship to the air/fuel ratio in the intake system of the engine, so that the air/fuel ratio equivalent of the exhaust gases entering into the main catalyst is maintained within the range of approximately 13.5–14.6. This is accomplished by a judicious design of the air control valve 20 with regard to the shape of the valve element 27 and shapes and dimensions of other various portions. Similarly, the amount of air supplied through the port 26 and the pipe 16 to the upstream side of the auxiliary catalyst 10 is determined so that the air/fuel ratio equivalent of the exhaust gases entering into the auxiliary catalyst is maintained within the range of approximately 14.5–18.0. In this connection, the difference in the amount of air injected in a normal operating condition and an accelerating condition as shown in graph d in FIG. 3, is obtained by a difference in the intake manifold vacuum between the normal operating condition and the accelerating condition, said difference in the intake manifold vacuum causing a corresponding difference in the shift position of the valve element 27.

If the load on the engine further increases, the intake manifold vacuum supplied to the diaphragm chamber 37 becomes smaller, whereby the valve element 27 is shifted upward in the Fig. until its flange portion 42 engages the peripheral portion of the port 28 thereby closing the port 28, while the port 29 is fully opened. In this condition, the supply of secondary air through the pipe 15 is intercepted while the air supplied from a source of compressed air such as the air pump 11 is almost totally relieved through the port 29 and the pipe 32. By this arrangement, the danger that the catalyst could be damaged by overheating during the high load operation of the engine, wherein otherwise the exhaust gases at a high temperature would be further heated up by the combustion of uncombusted components by secondary air and would become very hot, is precluded.

The valve element 40 is controlled by a diaphragm means 43. In more detail, the valve element 40 is connected with a diaphragm 48 by way of a rod element 44 and is shifted upward in the Fig. against the action of a compression coil spring 46 when the diaphragm 45 is biased upwards in the Fig. due to a supply of the intake manifold vacuum to a diaphragm chamber 47, such a supply of the intake manifold vacuum being made through a pipe 48 including a thermo-sensitive valve 49. When the engine temperature is below a predetermined level, as in the engine cold state, the thermo-sensitive valve is communicating, whereas when the engine has been warmed up beyond a predetermined temperature level, the valve becomes intercepted. By this arrangement, when the engine is in a cold state, the valve element 40 is shifted upward in the FIG. by the action of the intake manifold vacuum supplied to the diaphragm chamber 47, thereby opening the port 41. In this condition, the air supplied to the valve chamber 25 is principally bypassed through the port 41 to the valve chamber 30, wherefrom the air is conducted through the pipe 15 and is supplied to the exhaust gases at the upstream of the main catalyst. Therefore, a large amount of secondary air is supplied to the exhaust gases at the upstream side of the main catalyst, whereby a large amount of uncombusted components contained in the exhaust gases discharged from the engine operating in a cold state are effectively recombusted under the supply of secondary air as well as under the catalytic action effected by the main and auxiliary catalysts, thereby accomplishing the desired purification of exhaust gases. In such a cold state operation of the engine, the level of NOx is so low that no reducing action for this component is required.

The valve element 23 for protecting catalyst from being damaged by overheating is operated by a diaphragm means 50. In more detail, the valve element 23 is connected with a diaphragm 52 by way of a rod element 51. Diaphragm chambers 53 and 54 are defined at opposite sides of the diaphragm 52, these two diaphragm chambers being connected with each other through a passage formed in the rod element 51 and including an orifice 55. The diaphragm chamber 53 is supplied with the intake manifold vacuum through a pipe 56, whereas the diaphragm chamber 54 is opened to the atmosphere by way of a vacuum responsive valve 57 which is adapted to respond to the intake manifold vacuum so as to become communicating with the intake manifold vacuum is larger than a predetermined level while it becomes intercepted when the intake manifold vacuum is smaller than said predetermined level. When the valve 57 is intercepted, the vacuum supplied to the diaphragm chamber 53 through the pipe 56 is gradually transmitted to the diaphragm chamber 54 through the orifice 55, whereby the diaphragm 52 is shifted rightward in the Fig. by the action of a compression coil spring 58 so that the valve element 23 is maintained in the shown position wherein it engages the peripheral portion of a port 59 and closes the port 59. Such a shift condition of the valve element 23 is attained while the vehicle is in the normal driving condition. Starting from this condition, if the vehicle is decelerated, the intake manifold vacuum increases beyond a predetermined level to which the vacuum responsive valve 57 responds and it becomes to be communicating. Then, the diaphragm chamber 54 is opened to the atmosphere or atmospheric air flows into the diaphragm chamber 54, whereby the diaphragm 52 is shifted leftward in the Fig. against the action of the compression coil spring 58 thereby driving the valve element 23 to depart from the port 59 toward the port 24 thereby opening the port 59 while closing the port 24. In this condition, the air supplied to the valve chamber 22 through the air inlet port 21 is totally conducted through a pipe 60 so as to be introduced into the exhaust system at the upstream side of the main catalyst. The pipe 60 may be connected to a middle portion of the pipe 15 but it is more desirably connected to the exhaust system at an immediate upstream side of the main catalytic converter 9 as shown by phantom lines in FIG 2. While the vehicle is being decelerated, the intake throttle valve is fully closed, but nevertheless the engine is operating at a relatively high speed, being driven by the wheels of the vehicle. That is, during deceleration, an engine braking condition, the engine is driven from its output side. Therefore, the amount of secondary air available substantially in proportion to the rotational speed of the engine becomes very large relative to the amount of exhaust gases. In this operating condition, almost no NOx is generated, while noxious uncombusted components contained in the exhaust gases do not cause any problem because of their small absolute amount. Consequently, it is desirable to take this opportunity for effectively cooling down the main and auxiliary catalysts by supplying a relatively large amount of air at the entrance of the main catalytic converter while accomplishing simultaneous recombustion of the uncombusted components. By such occasional cooling operations, the catalysts are protected from being overheated and are able to effectively operate for a long period. Since HC and CO contained in exhaust gases can be recombusted at a temperature as low as about 300°-400° C., the purification of exhaust gases of HC and CO is accomplished even in the catalyst cooling process.

Although the invention has been shown and described with respect to a preferred embodiment thereof, it should be understood by those skilled in the art that various changes and omissions of the form and details thereof may be made therein without departing from the scope of the invention.

We claim:

1. An air control valve comprising a body, first, second, third, fourth and fifth valve chambers formed in said body and having individual port means opened towards the outside of said body, a first valve structure of a diaphragm type operable between a first shift position of communicating said first chamber to said second chamber while isolating said first chamber from said fifth chamber and a second shift position of isolating said first chamber from said second chamber while communicating said first chamber to said fifth chamber, a second valve structure of a diaphragm type having a single valve element and controlling communication and isolation of said second chamber to and from said third chamber as well as communication and isolation of said second chamber to and from said fourth chamber in a mutually related manner, a third valve structure of a diaphragm type for selectively communicating said second chamber to said third chamber, and a fourth valve structure of a springload type for selectively communicating said second chamber to said fourth chamber, wherein said first, second, third and fourth valve structures are incorporated in said body so as to provide an integral valve assembly.

2. The air control valve of claim 1, wherein said first valve structure includes a diaphragm means having a diaphragm, first and second diaphragm chambers defined at opposite sides thereof, a throttled passage means communicating said two diaphragm chambers with each other, and a spring for biasing said diaphragm toward a shift position which corresponds to said first shift position of said first valve structure.

3. The air control valve of claim 1, wherein said second valve structure includes a diaphragm means having a diaphragm, a diaphragm chamber defined at one side thereof, and a spring for biasing said diaphragm toward a shift position where the volume of said diaphragm chamber is the maximum, said shift position corresponding to the operating condition of said second valve structure of isolating said second chamber from said third chamber while communicating said second chamber to said fourth chamber.

4. The air control valve of claim 1, wherein said third valve structure includes a diaphragm means having a diaphragm, a diaphragm chamber defined at one side thereof and a spring for biasing said diaphragm towards a shift position where the volume of said diaphragm chamber is the maximum, said shift position corresponding to the operating condition of said third valve structure of not communicating said second chamber to said third chamber.

5. The air control valve of claim 1, wherein said fourth valve structure comprises a valve element and a spring for biasing said valve element toward a shift position corresponding to the operating condition of said fourth valve structure of not cmmunicating said second chamber to said fourth chamber.

6. The air control valve of claim 3, wherein said single valve element of said second valve structure is so shaped that when it is shifted to an extreme shift position by displacement of the diaphragm of said second valve structure to its another extreme shift position against the biasing action of said spring due to supply of vacuum to said diaphragm chamber, it isolates said second chamber from both said third chamber and said fourth chamber.

7. The air control valve of claim 3, wherein said port means of said second chamber includes a throttling orifice means.

8. A means for purifying exhaust gases of an internal combustion engine having an exhaust system, comprising a main catalyst including a 3-way catalyst, and an auxiliary catalyst which accelerates at least the oxidizing reaction, said main and auxiliary catalysts being provided in series in said exhaust sytem, a source means of compressed air having a predetermined output performance depending upon operational conditions of the engine, and an air distributing means comprising an air control valve comprising a body, first, second, third, fourth and fifth valve chambers formed in said body and having individual port means opened towards the outside of said body, a first valve structure of a diaphragm type operable between a first shift position of communicating said first chamber to said second chamber while isolating said first chamber from said fifth chamber and a second shift position of isolating said first chamber from said second chamber while communicating said first chamber to said fifth chamber, a second valve structure of a diaphragm type having a single valve element and controlling communication and isolation of said second chamber to and from said third chamber as well as communication and isolation of said second chamber to and from said fourth chamber in a mutually related manner, a third valve structure of a diaphragm type for selectively communicating said second chamber to said third chamber, and a fourth valve structure of a springload type for selectively communicating said second chamber to said fourth chamber, wherein said first, second, third and fourth valve structures are incorporated in said body so as to provide an integral valve assembly, said air control valve having a predetermined operational performance depending upon operational conditions of the engine and distributing the compressed air delivered from said source means to said exhaust system at the upstream sides of said 3-way catalyst and said auxiliary catalyst as first and second secondary airs, respectively, wherein the combined overall operational performance of said source means and said air distributing means makes the exhaust gases entering into said main catalyst to be of a reducing condition richer than the stoichiometric mixture having an air/fuel ratio equivalent of approximately 13.5–14.6, and makes the exhaust gases entering into said auxiliary catalyst to be of an oxidizing condition leaner than the stoichiometric mixture having an air/fuel ratio equivalent of approximately 14.5–18.0.

9. The means of claim 8, wherein said source means of compressed air is an air pump directly driven by the engine.

10. The means of claim 8, wherein said air distributing means includes an air control valve operated by the intake manifold vacuum of the engine.

* * * * *